US008201977B2

(12) United States Patent
Thomas et al.

(10) Patent No.: US 8,201,977 B2
(45) Date of Patent: Jun. 19, 2012

(54) LED ILLUMINATED MEMBER WITHIN A REFRIGERATED DISPLAY CASE

(75) Inventors: James Thomas, Tierra Verde, FL (US); Vladimir Volochine, Safety Harbor, FL (US)

(73) Assignee: ElectraLED, Inc., Largo, FL (US)

( * ) Notice: Subject to any disclaimer, the term of this patent is extended or adjusted under 35 U.S.C. 154(b) by 409 days.

(21) Appl. No.: 12/587,514

(22) Filed: Oct. 7, 2009

(65) Prior Publication Data

US 2011/0083460 A1 Apr. 14, 2011

Related U.S. Application Data

(60) Provisional application No. 61/195,399, filed on Oct. 7, 2008.

(51) Int. Cl.
*F21V 3/00* (2006.01)

(52) U.S. Cl. ..... 362/311.02; 62/264; 362/92; 362/125; 362/249.02; 362/222; 362/217.11

(58) Field of Classification Search ..... 362/92, 362/94, 125, 126, 249.02–249.06, 217.11, 362/217.12, 221–223, 311.02; 62/264
See application file for complete search history.

(56) References Cited

U.S. PATENT DOCUMENTS

| | | | |
|---|---|---|---|
| 3,936,686 | A | 2/1976 | Moore |
| 4,143,411 | A | 3/1979 | Roberts |
| 4,149,217 | A | 4/1979 | Tucker |
| 4,416,411 | A | 11/1983 | Desmond et al. |
| 4,612,206 | A | 9/1986 | Shimozato et al. |
| 4,612,606 | A | 9/1986 | Roberts |
| 4,720,773 | A | 1/1988 | Ahroni |
| 4,855,882 | A | 8/1989 | Boss |

(Continued)

FOREIGN PATENT DOCUMENTS

JP 3142490 6/2008

OTHER PUBLICATIONS

PCT/US2009/005506 International Search Report and Written Opinion of the International Searching Authority Mailed: May 12, 2010.

*Primary Examiner* — Stephen F Husar
(74) *Attorney, Agent, or Firm* — McDermott Will & Emery LLP

(57) ABSTRACT

The invention relates to a refrigerated display case with an illuminated support member or "mullion" that efficiently transfers heat generated by at least one light emitting diode (LED) to warm and maintain door seals. The invention further relates to a low-profile, elongated LED light fixture that is retrofitted to the display case mullion to provide efficient illumination. The LED light fixture includes an elongated frame having a central hub extending longitudinally along the frame. A pair of opposed arms extending upwardly at an angle from the central hub, wherein the terminus of each arm has a curvilinear configuration that defines a receiver. At least one leg extends rearward from the central hub. Two legs are spaced a distance apart to define an elongated central cavity that receives a fastener for securement of the fixture to the vertical support within the display case. A printed circuit board resides within a channel of the central hub and a plurality of LEDs are electrically and mechanically connected to the circuit board. A substantially planar lens cover resides within the receiver for securement to the frame.

12 Claims, 5 Drawing Sheets

U.S. PATENT DOCUMENTS

| | | | |
|---|---|---|---|
| 4,908,743 | A | 3/1990 | Miller |
| 5,015,918 | A | 5/1991 | Copeland |
| 5,103,382 | A | 4/1992 | Kondo et al. |
| 5,222,799 | A | 6/1993 | Sears et al. |
| 5,499,170 | A | 3/1996 | Gagne |
| 5,526,236 | A | 6/1996 | Burnes et al. |
| 5,607,227 | A | 3/1997 | Yasumoto et al. |
| 5,697,175 | A | 12/1997 | Schwartz |
| 5,746,497 | A | 5/1998 | Machida |
| 5,857,767 | A | 1/1999 | Hochstein |
| 5,892,192 | A | 4/1999 | Ishiguro et al. |
| 5,924,785 | A | 7/1999 | Zhang et al. |
| 5,931,577 | A | 8/1999 | Ishibashi |
| 6,045,240 | A | 4/2000 | Hochstein |
| 6,072,280 | A | 6/2000 | Allen |
| 6,116,748 | A | 9/2000 | George |
| 6,137,648 | A | 10/2000 | Higurashi |
| 6,183,104 | B1 | 2/2001 | Ferrara |
| 6,244,728 | B1 | 6/2001 | Cote et al. |
| 6,283,612 | B1 | 9/2001 | Hunter |
| 6,346,777 | B1 | 2/2002 | Kim |
| 6,350,039 | B1 | 2/2002 | Lee |
| 6,371,637 | B1 | 4/2002 | Atchinson et al. |
| 6,394,626 | B1 | 5/2002 | McColloch |
| 6,396,466 | B1 | 5/2002 | Pross et al. |
| 6,416,200 | B1 | 7/2002 | George |
| 6,431,728 | B1 | 8/2002 | Fredericks et al. |
| 6,573,536 | B1 | 6/2003 | Dry |
| 6,578,979 | B2 | 6/2003 | Truttmann-Battig |
| 6,578,986 | B2 | 6/2003 | Swaris et al. |
| 6,617,520 | B1 | 9/2003 | Martter et al. |
| 6,641,283 | B1 | 11/2003 | Bohler |
| 6,665,170 | B1 | 12/2003 | Warner et al. |
| 6,712,486 | B1 | 3/2004 | Popovich et al. |
| 6,815,724 | B2 | 11/2004 | Dry |
| 6,831,303 | B2 | 12/2004 | Dry |
| 6,846,093 | B2 | 1/2005 | Swaris et al. |
| 7,114,831 | B2 | 10/2006 | Popovich et al. |
| 7,121,675 | B2 | 10/2006 | Ter-Hovhannisian |
| 2001/0015891 | A1 | 8/2001 | Suzuki et al. |
| 2003/0218878 | A1 | 11/2003 | Swaris et al. |
| 2005/0265019 | A1 | 12/2005 | Sommers et al. |
| 2007/0047229 | A1 | 3/2007 | Lee |
| 2007/0159820 | A1 | 7/2007 | Crandell et al. |
| 2008/0007945 | A1 | 1/2008 | Kelly et al. |
| 2010/0103672 | A1* | 4/2010 | Thomas et al. ..... 362/235 |

* cited by examiner

LED ILLUMINATED MEMBER WITHIN A REFRIGERATED DISPLAY CASE

CROSS-REFERENCE TO RELATED APPLICATIONS

This application claims priority from and the benefit of U.S. Provisional Application No. 61/195,399, filed Oct. 7, 2008, which is incorporated herein by reference and made a part hereof.

FEDERALLY SPONSORED RESEARCH OR DEVELOPMENT

Not applicable.

TECHNICAL FIELD

The invention relates to a refrigerated display case with an illuminated support member or "mullion" that efficiently transfers heat generated by at least one light emitting diode (LED) to warm and maintain door seals. The invention further relates to a low-profile, elongated LED light fixture that is retrofitted to the display case mullion to provide efficient illumination.

BACKGROUND OF THE INVENTION

Refrigerated display cases, often referred to as coolers or freezers, are commonly found in grocery stores, markets, convenience stores, liquor stores and other retail businesses for the preservation and display of food and beverages. Conventional display cases comprise an inner refrigerated space defined by a collection of structural elements or members, and an opening further defined by the structural elements that is accessible by a sliding or swinging door. Typically, the door is formed from a plurality of frame members that support at least one layer of glass and a handle. The collection of structural elements that form the display case include interior and exterior frame members, including "mullions" which are vertical elements that extend between upper and lower frame members, typically in a frontal area of the display case. An end mullion is a peripheral vertical element that is located at one end of the display case, and a center mullion is a central vertical element that is located between two openable doors. The mullion provides an engaging surface for the door seals that are used to maintain the lower temperature within the display case. As such, the mullion is part of a door frame sealing system for the free-standing display case.

Certain retail businesses, such as convenience and liquor stores, include a "walk-in" cooler or room instead of a free-standing refrigerated display case. These walk-in coolers are not free-standing as recognized within the industry, however, they include a number of similar components including mullions and openable doors with seals.

Regardless of whether the refrigerated case is free-standing or walk-in, the door frame members and the door glass conduct ambient heat into the display case and function as a condensation surface for water vapor present in the ambient air. Also, the opening of the doors by consumers to access the food or beverage products within the case increases the heat transfer and condensation formation. To reduce condensation on the door frame and glass, and fogging of the door glass, a heating element or wire may be installed within the door frame and/or mullion to warm the door seals and frame and thereby reduce condensation. In addition, warming of the door seals increases the effectiveness of the seal between the door and the mullion, and increases the integrity and lifetime of the seal. Of course, the operating costs of the case is further increased by the energy consumed by the heating element.

The present invention seeks to overcome certain of these limitations and other drawbacks of the prior art, and to provide new features not heretofore available. A full discussion of the features and advantages of the present invention is deferred to the following detailed description, which proceeds with reference to the accompanying drawings.

SUMMARY OF THE INVENTION

The present invention is directed to a display or walk-in cooler with an illuminated mullion that efficiently transfers heat generated by LEDs to warm the door seals and reduce the energy consumption of the cooler. The present invention is also directed to a low-profile, elongated LED light fixture that is retrofitted to the display case mullion to provide efficient illumination.

Other features and advantages of the invention will be apparent from the following specification taken in conjunction with the following drawings.

BRIEF DESCRIPTION OF THE DRAWINGS

To understand the present invention, it will now be described by way of example, with reference to the accompanying drawings in which.

DETAILED DESCRIPTION

Figure 1:
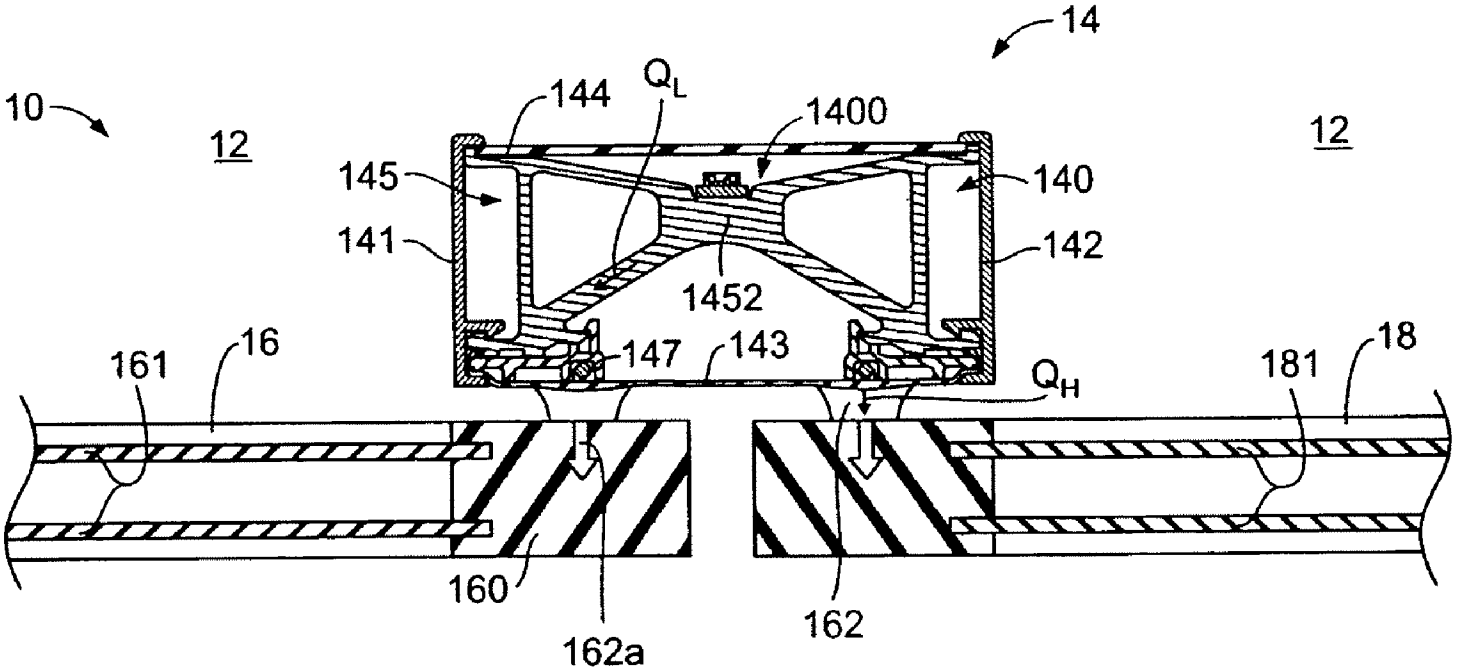
FIG. 1 is a partial cross-section of a refrigerated display case of the present invention, showing a LED illuminated mullion and two openable doors.

While this invention is susceptible of embodiments in many different forms, there are shown in the drawings and will herein be described in detail preferred embodiments of the invention with the understanding that the present disclosure is to be considered as an exemplification of the principles of the invention and is not intended to limit the broad aspect of the invention to the embodiments illustrated.

Figure 2:
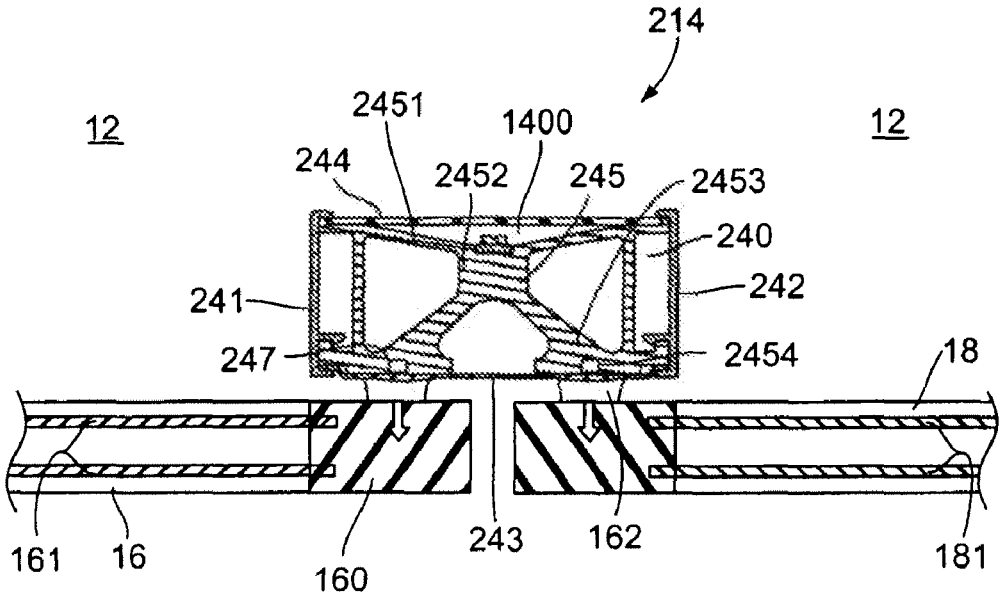
FIG. 2 is a partial cross-section of a refrigerated display case of the present invention, showing a second LED illuminated mullion and two openable doors.
Figure 3:
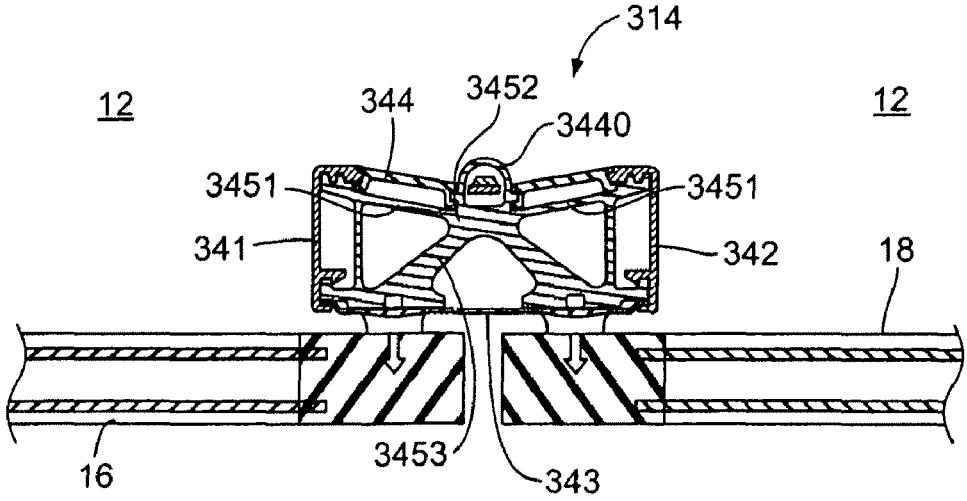
FIG. 3 is a partial cross-section of a refrigerated display case of the present invention, showing a third LED illuminated mullion and two openable doors.

FIGS. 1-3 show a partial cross-section of a refrigerated display case 10 of the present invention. The display case 10 comprises a plurality of structural elements or members (not shown) that form the inner refrigerated space 12, and an illuminated central mullion 14 that resides between a first door 16 and a second door 18. Although not shown in these Figures, the display case 10 also includes illuminated end mullions at the periphery of the case 10. Conventional refrigerated display cases are disclosed in U.S. Pat. Nos. 6,637,093 and 6,606,833. The illuminated mullion of the present invention can also be utilized with walk-in coolers, which differ from standalone display cases or coolers.

Figure 4:
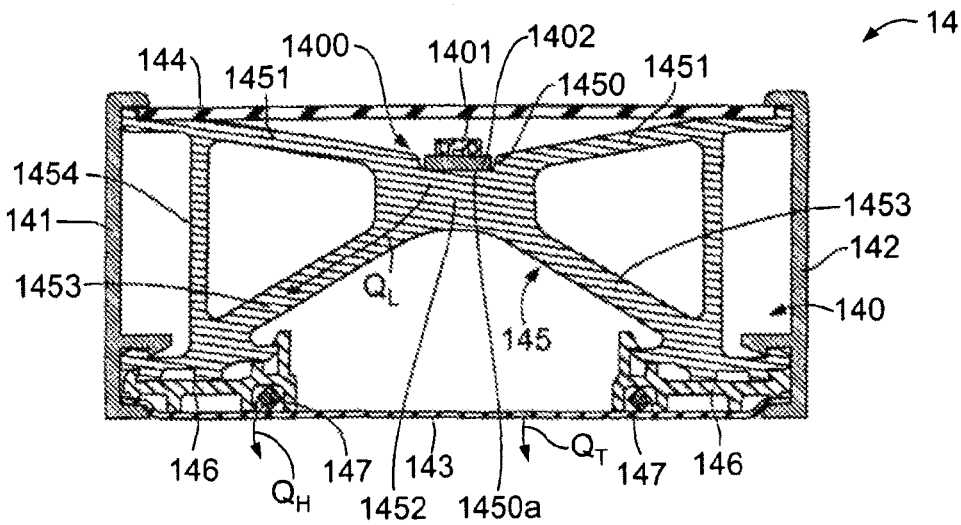
FIG. 4 is a cross-section of the illuminated mullion of FIG. 1.

Referring to FIGS. 1 and 4, the illuminated central mullion 14 has internal cavity 140 defined by a first side piece 141 and a second side piece 142 (both preferably plastic), a back plate 143 and a lens or generally transparent cover 144. An internal support 145 resides within the cavity 140 and includes an illumination assembly 1400 comprised of at least one light emitting diode (LED) 1401 electrically and mechanically connected to a printed circuit board (PCB) 1402. The back plate 143 and the internal support 145 are preferably formed from a thermally conductive material such as metal, namely aluminum. Preferably, the PCB 1402 is received by a channel 1450 of the internal support 145. Depending upon the length of the mullion 14, multiple LEDs 1401 are mounted to a number of PCBs 1402 secured to the internal support 145, wherein the PCBs 1402 are longitudinally secured in an end-to-end configuration. The internal support 145 has a pair of front arms 1451 that extend from a central hub 145-2 and that provide a reflecting surface for light generated by the LEDs 1401 through the lens 144 and into the refrigerated space 12 in order to evenly illuminate the food and/or beverage products therein. The reflecting surface of the front arm 1451 ranges from 0 to 60 degrees from horizontal, and is preferably 10-15 degrees from horizontal, and is most preferably 11-12 degrees from horizontal (wherein the angle is defined by a horizontal reference line that is parallel to a bottom wall 1450*a* of the channel 1450, and preferably aligned with the bottom wall 1450*a*). The outer surface 1451*a* of the front arm 1451 is treated to increase the reflection of light from the LEDs 101 into the refrigerated space 12. For example, the outer surface 1451*a* is buffed to provide a coefficient of reflection of 85 to 95, or a reflective tape is attached to the outer surface 1451*a*. The tape or coating secured to the outer surface 1451*a* may include metal particles and/or fibers. Also, the outer surface 1451 a may be anodized to electrically insulate the front arm 1451. At least one rear arm 1453 extends from the central hub 1452 and engage a connector 146 for a heating element 147. A peripheral arm 1454 extends between the front arm 1451 and the rear arm 1453. As explained in greater detail below, during operation of the illumination system 1400, the internal support 145 transfers heat generated by the LEDs 1401 through the connector 146 to the back plate 143. Although not shown, the internal support 145 may include an additional arm that bypasses the connector 146 and directly contacts the back plate 143.

The first and second door assembly 16, 18 include a collection of frame member 160, at least one layer of display glass 161 and a sealing element or seal 162. The seal 162 includes a projection 162*a* that is received within a recess of the frame member 160 to secure the seal 162 to the member 160. In the closed door position of FIG. 1, an inner surface of the seal 162 is positioned against the back plate 143 and an outer surface of the seal 162 is positioned against the frame member 161, whereby the seal 162 is sandwiched between the mullion 14 and the door 16, 18 to maintain the temperature within the display case 10. Although not shown, it is understood that the mullion 14, the frame member 160 and the seal 162 have a substantial vertical dimension or height that extends within the display case 10.

In the embodiment of FIG. 2, the illuminated central mullion 214 has an internal cavity 240 defined by a first side piece 241 and a second side piece 242, a back plate 243 and a lens or generally transparent cover 244. An internal support 245 has at least one front arm 2451 and at least one rear arm 2453 both extending from the central hub 2452. The rear arm 2453 is configured with a receiver 2454 that receives the heating element 247, thereby omitting the connector 146. In this configuration, there is direct heat transfer from the LEDs 1401 and through the internal support 245 and the rear arm 2453 to the back plate 243. Compared to the rear arm 1453 of the internal support 145 of FIG. 1, the rear arm 2453 is larger with an increased interface area with the back plate 243 that contacts a seal 162. In the embodiment of FIG. 3, the illuminated central mullion 314 is similar to the central mullion 214 but includes a differently configured first side piece 341 and second side piece 342 that engage a lens cover 344 with a bulbous central portion 3440 that accommodates a raised illumination assembly 1400.

During operation of the display case 10, the LEDs 1401 of the illumination assembly 1400 generate significant heat $Q_L$ while illuminating the food and/or beverage contents within the case 10. For the mullion 14, heat $Q_L$ is transferred through the central hub 1452 and the rear arms 1453 and the connector 146 to the back plate 143. Therefore, a heat path for heat $Q_L$ is defined through the internal support 145. Regarding the mullion 214, heat $Q_L$ is transferred through the central hub 2452 and the rear arms 2453 to the back plate 243 and then the seals 162. For the mullion 314, heat $Q_L$ is transferred through the central hub 3452 and the rear arms 3453 to the back plate 343 and then the seals 162. Transferring the heat $Q_L$ through the central hub 1452, 2452; 3452 and the rear arms 1453, 2453, 3453 to the back plate 143, 243, 343 increases the operating efficiency of the display case 10 because the heat load, which is a function of heat $Q_L$, is not transferred into the refrigerated space 12. Display cases have the illuminated mullion 14, 214, 314 are far more efficient than display cases with a conventional illumination assembly (often referred to as a "cooler stick") which transfer the heat load into the refrigerated space which then must be dealt with by the refrigeration components. For example, the condenser pump (with an efficiency of 45%) consumes 145 watts to remove 100 watts generated by the conventional illumination assembly. By transferring the heat load (and the heat $Q_L$) to the back plate 143, 243, 343 for heating of the seals 162 and not into the refrigerated space 12, the inventive display cases 10 reduces the consumption of energy by the condenser pump which increases the operating efficiency of the case 10 and the life of the pump.

The heat $Q_L$ may be combined with the heat $Q_H$ generated by the heating element 147 to further warm the back plate 143, which in turn warms the seals 162. Essentially, heat from two different sources—the heat $Q_L$ generated by the LEDs 1401 and the heat $Q_H$ generated by the element 147—can be utilized, depending upon the operating conditions of the display case 10 to warm and maintain the integrity of the seals 162. Due to the contribution of heat $Q_L$ provided from the LEDs 1401 and transferred by the internal support 145, considerably less heat $Q_H$ is required from the element 147 to attain the total heat $Q_T$ needed to warm the seals 162 and prevent condensation on the door frame 160 and glass 161. Consequently, the energy consumption of the heating element 147 is reduced and the efficiency of the display case 10 is increased. Therefore, the method of heating the seal 162 to maintain its suitable temperature involves contributions from distinct sources, the heat $Q_L$ generated by the LEDs 1401 and transferred by the internal support 145, and the heat $Q_H$ generated by the element 147. The total heat $Q_T$ corresponds to the amount of heat transferred by the back plate 143 to the seals 162.

The method of heating the seals 162 is affected by the operating conditions of the display case 10 and the illumination assembly 1400. In a first operating mode of the method, when the store or building in which the display case 10 is open for business and the illumination assembly 1400 is operational to illuminate the display case 10, the heat $Q_L$ provided from the LEDs 1401 is sufficient to heat the seals 162 without any contributions from the element 147 (wherein heat $Q_H$ is zero). Thus, the total heat is defined as $Q_T=Q_L$ in order to heat the seals 162 and prevent condensation on the door frame 160 and glass 161. In a second operating mode of the method, when the store or building is closed and the illumination assembly 1400 is not operational, the heat $Q_L$ provided from the LEDs 1401 is essentially zero and the heater element 147 is operated to provide heat $Q_H$ to warm the seals 162. In this operating mode, where the heater element 147 consumes approximately 100 watts, the total heat reduces to $Q_T=Q_H$. In a third operating mode of the method, when the store is open and the illumination assembly 1400 is generating a reduced amount of heat $Q_L$ (compared to the heat generated in the first operating mode), the heater element 147 can be operated at a reduced level or throttled to provide a relatively small contribution of heat $Q_H$ (compared to the heat generated in the second operating mode, e.g. 10-20 watts versus 100 watts in the second mode). Thus, the total heat is defined as $Q_T=Q_L+Q_H$ (where $Q_L$ exceeds $Q_H$) in order to heat the seals 162 and prevent condensation. The third operating mode can result from the use of a dimmer and/or a motion detection system that adjusts the output of the illumination assembly 1400 based upon pre-set conditions, including the presence or absence of customers near the display case 10.

Figure 5:
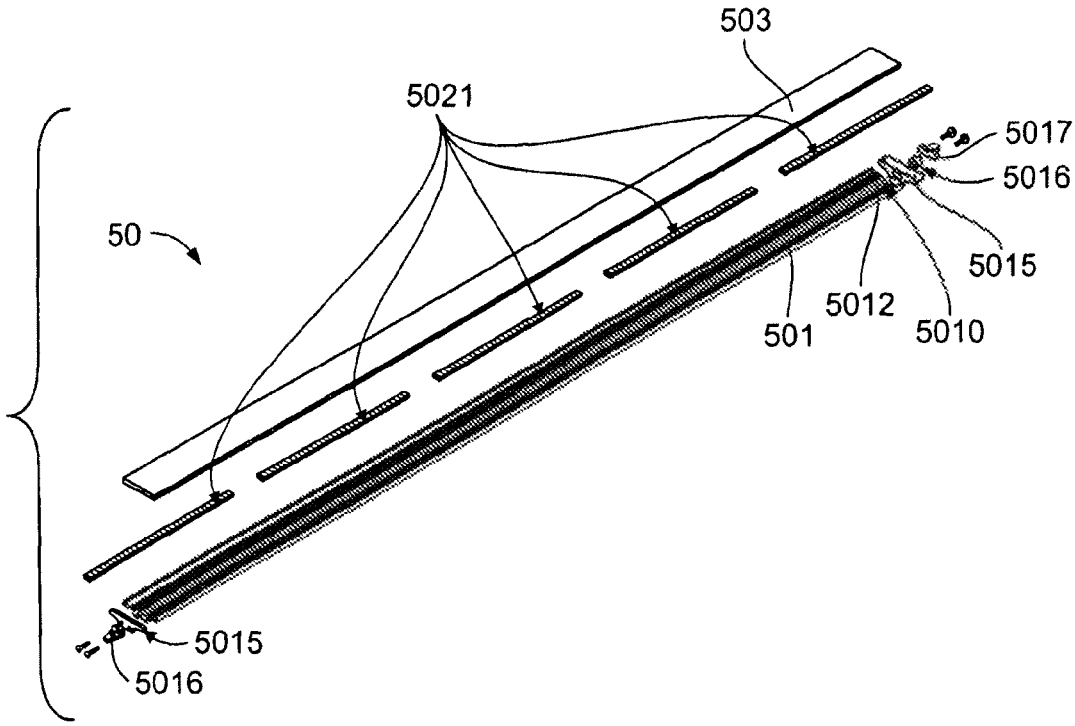
FIG. 5 is an exploded view of a first LED fixture suitable for retrofit to a center mullion in a display case.
Figure 6:
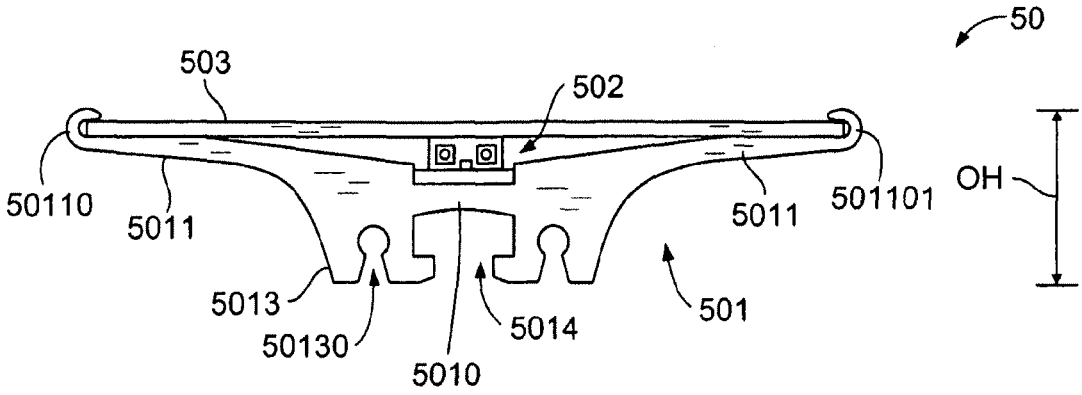
FIG. 6 is an end view of the LED fixture of FIG. 5.
Figure 7:
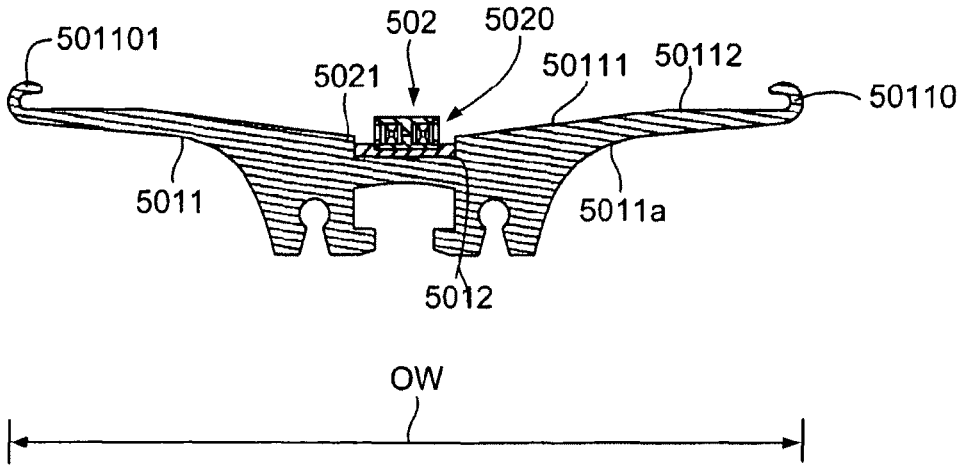
FIG. 7 is cross section of the LED fixture of FIG. 5.

FIGS. 5-7 show an alternate low-profile, elongated LED fixture 50 that is configured to be secured to an existing center frame member or center mullion within a display case or walk-in cooler, in a retrofit manner. The center fixture 50 includes an elongated frame or housing 501, a light engine or illumination assembly 502 comprised of at least one light emitting diode (LED) 5020 electrically and mechanically connected to a printed circuit board (PCB) 5021, and a substantially planar lens or cover 503. Referring to FIGS. 6 and 7, the support frame 501 includes a central hub 5010 and a pair of outwardly and upwardly extending arms 5011. Preferably, the PCB 5021 is partially received within a channel 5012 of the central hub 5010. The channel 50121 has a recessed depth of 0.05 to 0.07 inch, and preferably 0.06 inch. The arms 5011 provide a reflecting surface for light generated by the LEDs 5020 through the lens 503 and into the refrigerated space in order to evenly illuminate the food and/or beverage products therein. At least one rear leg 5013 extends from the central hub 5010 and includes an elongated recess 50130 that receives a projection or lip of the mullion to enable coupling of the fixture 50. In the embodiment of FIGS. 5-7, the rear legs 5013 depend from the central hub 5010 to define a central cavity 5014 that is configured to receive a fastener for securement of the fixture 50 to the mullion within the display case. Preferably, the cavity 5014 extends along the length of the frame 501. The central cavity 5014 is substantial with a depth from the edge of the legs 5013 to the central hub 5010 that is 0.175 to 0.225 inch, and preferably is 0.2 inch, and a width of 0.3 to 0.4 inch, and preferably 0.320 inch.

As shown in FIGS. 6 and 7, each arm 5011 has a curvilinear terminus 501101 that defines a receiver 50110 that receives an edge of the lens 503 for securement of same without a fastener. The arm 5011 includes a curvilinear lower surface 5011*a*, while the upper surface comprise two linear segments—an inner linear surface segment 50111 and an outer linear surface segment 50112, the latter being substantially parallel to the bottom wall 5012*a* of the channel 5012. Preferably, the inner linear segment 50111 is polished or buffed to provide a coefficient of reflection of 85 to 95, while the outer linear segment 50112 is not similarly polished. The inner linear segment 50111 is inclined with an angle ranging from 5 to 15 degrees from horizontal, and is preferably 6 to 10 degrees from horizontal, and most preferably 7 to 8 degrees from horizontal (wherein the angle is defined by a horizontal reference line that is parallel to a bottom wall of the channel 5012). The angle between the inner linear segment 50111 and the outer linear segment 50112 is 180 to 190 degrees, preferably 185 to 190 degrees, and most preferably 187 degrees. These angles are optimized based upon the performance characteristics of the illumination assembly 502, namely the LEDs 5020. The inner and outer linear segments 50011, 50112, the terminus 50110 and the receiver 50111 all reside above the central hub 5010. Since the fixture 50 includes symmetric arms 5011 to evenly distribute light from left to right and throughout the display case, it is configured to be joined to a center mullion or support frame. Once coupled to the mullion or support frame, the LED support fixture 50 functions in a manner similar to that described above to transfer heat from the illumination assembly 502 to heat the door seal(s) and reduce energy consumption of the heating element, and thereby increase the efficiency of the display case. Due to the inclined span of the symmetric arms 5011, the frame 501 has a "low-profile" configuration with an overall height OH (see FIG. 6), which is defined as the distance between the lowermost edge of the rear legs 5013 and the uppermost edge of the receiver 50110, that is 0.5 to 0.7 inch, preferably 0.5 to 0.6 inch, and most preferably 0.535 inch. Also due to the span of the arms 5011, the frame 501 has an overall width OW (see FIG. 7), which is defined as the distance between the outermost surface of the receivers 50110, of 2 to 3 inches, preferably 2.25 to 2.75 inches, and most preferably 2.5 inches. Thus, the aspect ratio, meaning the ratio of the most preferred width to height of the fixture 50 is 2.5:0.535 or 4.67, which facilitates installation of the fixture 50 without interfering with the operation of the display case. In addition, the lowermost edge of the inner linear segment 50011 is 0.06 inch above the bottom wall 5012*a* of the channel 5012, which bounds the upper extent of the central hub 5010. The low-profile configuration of the fixture 50 ensures that the fixture 50 does not compromise the ingress and egress of display case 10 once the fixture 50 is retrofitted to a mullion or support member of the case 10.

As shown in FIG. 5, the illumination assembly 502 includes multiple PCBs 5021 electrically joined inline by a connector. Preferably, each PCB 5021 includes a plurality of LEDs 5020, which may be Nichia NS6W083 or Citizen CL-820 or CL-822 LEDs. In one embodiment of the fixture 50 having 30 LEDs 5020 arranged in five parallel groups of six serial LEDs 5020, wherein each group includes a resistor. The fixture 50 is connected to a low voltage power source and a bridge rectifier, an arrangement of four diodes in a bridge configuration that provides the same polarity of output voltage for either polarity of input voltage, is positioned between the power source and the arrangement of LEDs 5020. The bridge rectifier converts alternating current (AC) input into direct current (DC) output to provide full-wave rectification from a two-wire AC input. Referring to FIG. 5, the fixture 50 includes an end cap 5015 that include at least one aperture that receives an elongated fastener 5016 that is also received by the recess 50130 to secure the end cap 5015 to the frame 501. The end cap 5015 also includes at least one opening that receives leads 5017 from an external, low voltage power supply (not shown).

Figure 8:
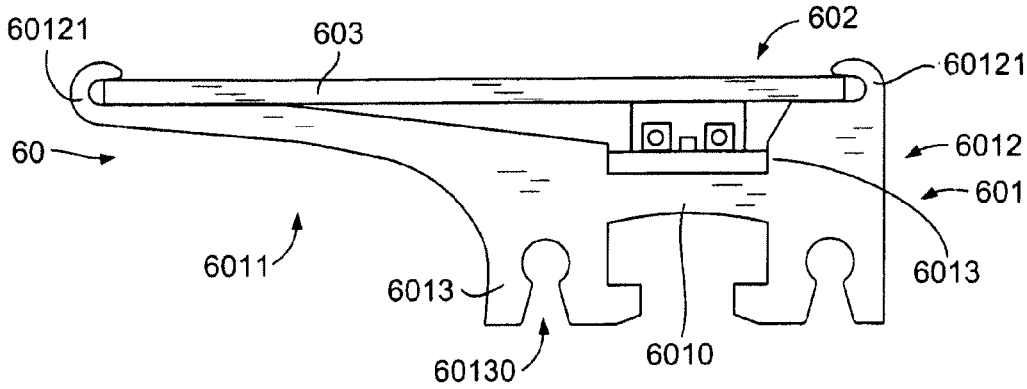
FIG. 8 is an end view of a second LED fixture suitable for retrofit to an end mullion in a display case; and, FIG. 9 is a cross-section of the LED fixture of FIG. 8.
Figure 9:
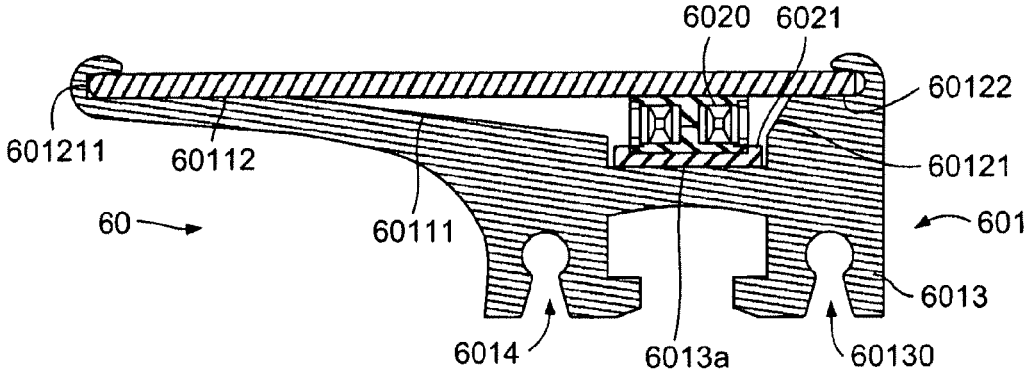

FIGS. 8 and 9 show an alternate LED support fixture 60 configured to an existing corner frame member or end mullion within a display case or walk-in cooler, in a retrofit manner. The fixture 60 includes an elongated support frame 601, an illumination assembly 602 (similar to illumination assembly 1400 and 502) comprised of at least one light emitting diode (LED) 6020 electrically and mechanically connected to a printed circuit board (PCB) 6021, and lens or cover 603. The support frame 601 includes a central hub 6010, an outwardly extending arm 6011 and a shoulder segment 6012, which have a curvilinear terminus 60121 that defines a receiver 601211 that receives an edge of the lens 603 for securement of same without a fastener. The arm 6011 and shoulder 6012 provide a reflecting surface for light generated by the LEDs 6020 through the lens 603 and into the refrigerated space 12 in order to evenly illuminate the food and/or beverage products therein. The arm 6011 includes an inner linear segment 60111 and an outer linear segment 60112, the latter being substantially parallel to the bottom wall 6013*a* of the channel 6013. The inner linear segment 6011 provides a reflecting surface that ranges from 0 to 60 degrees from horizontal, preferably 10-15 degrees from horizontal, and most preferably 12 degrees. The angle between the inner linear segment 60111 and the outer linear segment 60112 is 180 to 190 degrees, preferably 185 to 190 degrees, and most preferably 187 degrees. The shoulder 6012 includes an inner linear segment 60121 extending from the channel 6013 and an outer linear segment 60122, wherein the angle between the inner linear segment 60121 and the outer linear segment 60122 is substantially 120 degrees. The inner linear segment 60121 provides a reflecting surface and is oriented substantially 60 degrees from horizontal. These angles are optimized based upon the performance characteristics of the illumination assembly 602, namely the LEDs 6020.

At least one rear leg 6013 extends from the central hub 6010 and includes an elongated recess 60130 that receives a fastener to secure an end cap to the fixture 60. In the embodiment of FIGS. 8 and 9, the rear legs 6013 depend from the central hub 6010 to define a central cavity 6014 that is configured to receive a fastener for securement to the end mullion within the display case. Once coupled to the end mullion or end support frame, the LED support fixture 60 functions in a manner similar to that described above to transfer heat from the illumination assembly 602 to heat the door seal(s) and reduce energy consumption of the heating element, and thereby increase the efficiency of the display case. Due to the inclined span of the arms 6011 and the shoulder 6012, the frame 601 has a "low-profile" configuration with an overall height OH that is 0.5 to 0.7 inch, preferably 0.5 to 0.6 inch, and most preferably 0.535 inch. Also due to the span of the arm 6011 and the shoulder 6012, the frame 601 has an overall width OW, which is the distance between the outermost surface of the receivers 60110, of 1.5 to 2 inches, preferably 1.5 to 1.75 inches, and most preferably 1.7 inch. Thus, the aspect ratio, meaning the ratio of the most preferred width to height of the fixture 60 is 1.7:0.535 or 3.17, which facilitates installation of the fixture 60 in the corner of the display case without interfering with its operation.

The illuminated mullion 14 and the LED support fixture 50, 60 may include a controller including a motion sensor, for example an optical sensor or an acoustical sensor, and/or temperature sensor, for example a thermocouple, that measures the internal temperature of the refrigerated space 12 within the display case 10. When the motion sensor detects the presence of people near the display case 10, then the controller increases the output of the illumination assembly 1400, 502, 602. Similarly, when the motion sensor no longer detects the presence of people near the display case 10, then the controller decreases, either partially (e.g., dimming) or fully, the output of the illumination assembly 1400, 502, 602. When the temperature sensor detects an internal temperature that exceeds a preset threshold, a controller linked to the sensor reduces the output of the illumination assembly 1400, 502, 602, either partially (e.g., dimming) or fully, to increase the operating life of the assembly 1400, 502, 602. An example of this situation occurs when the compressor within the display case 10 is shut off for maintenance of the case 10.

In addition, the illuminated mullion 14 and the LED support fixture 50, 60 may include a wired or wireless module, primarily a radio frequency control unit, that allows for remote control of the illumination unit and/or the heating element. The radio frequency control unit can be factory assembled into the housing as original equipment, or added to the housing or frame in the field by a service technician. In general terms, the radio frequency control unit allows an operator to remotely turn on, turn off, or adjust (e.g., dim) the illumination assembly of a single unit or a group of units to any desired brightness/output level. The remote interaction resulting from the control unit provides a number of benefits to the invention, including longer operating life for the components, lower energy consumption, and lower operating costs. The radio frequency control unit may also include high and low output switches or settings.

The radio frequency control unit comprises a number of components including a transceiver (or separate receiver and transmitter components), an antenna, and control interface for a power supply. The control interface includes a connector containing input signals for providing raw power to the control unit, as well as output signals for controlling the power supply itself. In operation, the control unit interacts with the power supply to allow an operator to power on, power off, or dim the brightness of the fixture. To ensure reception of the operating signals, the control unit utilizes an embedded antenna, or an external antenna coupled to the housing for better wireless reception. The radio frequency control unit can receive commands from a centralized controller, such as that provided by a local network, or from another control module positioned adjacent a mullion in close proximity. Thus, the range of the lighting network could be extended via the relaying and/or repeating of control commands between control units.

In a commercial facility or building having multiple refrigerated display cases 10 or walk-in coolers, each inventive mullion 14 may be assigned a radio frequency (RF) address or identifier, or a group of mullions 14 are assigned the same RF address. An operator interfacing with a lighting control network can then utilize the RF address to selectively control the operation and/or lighting characteristics of all mullions 14, a group of mullions 14, or individual mullions 14 (or display cases 10) within the store. For example, all mullions 14 having an RF address corresponding to a specific function or location within the store, such as the loading dock or shipping point, can be dimmed or turned off when the store is closed for the evening. The operator can be located within the store and utilize a hand held remote to control the group of mullions 14 and/or individual mullions 14. Alternatively, the operator may utilize a personal digital assistant (PDA), a computer, or a cellular telephone to control the mullions 14. In a broader context where stores are located across a broad geographic region, for example across a number of states or a country, the mullions 14 in all stores may be linked to a lighting network. A network operator can then utilize the RF address to control: (a) all mullions 14 linked to the network; (b) the mullions 14 on a facility-by-facility basis; and/or (c) groups of mullions 14 within a facility or collection of facilities based upon the lighting function of the mullions 14.

A centralized lighting controller that operably controls the mullions 14 via the control units can be configured to interface with an existing building control system or lighting control system. The central lighting controller may already be part of an existing building control system or lighting control system, wherein the mullions 14 and the control unit are added as upgrades. The radio frequency control unit could utilize a proprietary networking protocol, or use a standard networking control protocol. For example, standard communication protocols include Zigbee, Bluetooth, IEEE 802.11, Lonworks, and Backnet protocols.

While the specific embodiments have been illustrated and described, numerous modifications come to mind without significantly departing from the spirit of the invention, and the scope of protection is only limited by the scope of the accompanying Claims.

What is claimed is:

1. A low-profile, elongated LED light fixture connectable to a vertical support in a refrigerated display case, the light fixture comprising:

an elongated frame having a central hub extending longitudinally along the frame, a pair of opposed arms extending upwardly at an angle from the central hub wherein the terminus of each arm has a curvilinear configuration that defines a receiver, and a pair of legs that extends rearward from the central hub;

a printed circuit board and a plurality of LEDs electrically and mechanically connected to the circuit board, wherein the printed circuit board resides within a channel of the central hub; and, a lens cover residing within the receiver for securement to the frame.

2. The LED light fixture of claim 1, wherein each arm includes an upper surface comprised of an inner linear surface segment and an outer linear surface segment.

3. The LED light fixture of claim 2, wherein the outer linear surface segment is substantially parallel to a bottom wall of the channel.

4. The LED light fixture of claim 2, wherein the inner linear surface segment and the outer linear surface segment are angularly oriented 185 to 190 degrees apart.

5. The LED light fixture of claim 2, wherein the inner linear surface segment is angularly oriented 6 to 10 degrees from horizontal.

6. The LED light fixture of claim 1, wherein two legs are spaced a distance apart to define a central cavity that receives a fastener for securement of the fixture to the vertical support within the display case, wherein the cavity extends longitudinally along the length of the frame.

7. The LED light fixture of claim 1, wherein the frame has an overall height, which is defined as the distance between the lowermost edge of the rear legs and the uppermost edge of the receiver, that is 0.5 to 0.7 inch.

8. The LED light fixture of claim 7, wherein the overall height is 0.5 to 0.6 inch.

9. The LED light fixture of claim 1, wherein the frame has an overall width, which is defined as the distance between the outermost surface of the receivers, that is 2 to 3 inches.

10. The LED light fixture of claim 9, wherein the overall width is 2.25 to 2.75 inches.

11. The LED light fixture of claim 1, wherein the frame has an overall height, which is defined as the distance between the lowermost edge of the rear legs and the uppermost edge of the receiver, that is 0.5 to 0.7 inch, and wherein the frame has an overall width, which is defined as the distance between the outermost surface of the receivers, that is 2 to 3 inches.

12. The LED light fixture of claim 11, wherein the overall height is 0.5 to 0.6 inch and the overall width is 2.25 to 2.75 inches.

* * * * *